United States Patent [19]

Shindo et al.

[11] Patent Number: 4,664,640

[45] Date of Patent: May 12, 1987

[54] TOY FOR USE WITH INFANT FURNITURE

[75] Inventors: Yasushi Shindo, Tokyo, Japan; Toshiaki Kurita, Torrance, Calif.

[73] Assignee: Tomy Kogyo Co., Inc., Tokyo, Japan

[21] Appl. No.: 694,141

[22] Filed: Jan. 22, 1985

[51] Int. Cl.[4] ..... A63H 33/00

[52] U.S. Cl. ..... 446/227; 446/397; 446/229; 74/409

[58] Field of Search ..... 446/227, 444, 446, 442, 446/441, 443, 428, 427, 445, 404, 397, 228, 229; 74/409; 238/10 C, 10 E, 10 F, 10 R

[56] References Cited

U.S. PATENT DOCUMENTS

| | | | |
|---|---|---|---|
| 3,331,153 | 7/1967 | Woods | 446/442 X |
| 3,615,092 | 10/1971 | Stubbmann . | |
| 4,198,049 | 4/1980 | Kurita . | |
| 4,285,159 | 8/1981 | Bass et al. | 446/227 X |
| 4,294,159 | 10/1981 | Wendler et al. | 74/409 X |
| 4,394,961 | 7/1983 | Muller | 238/10 F X |

FOREIGN PATENT DOCUMENTS

| | | | |
|---|---|---|---|
| 2749472 | 6/1978 | Fed. Rep. of Germany | 446/442 |

*Primary Examiner*—Mickey Yu
*Attorney, Agent, or Firm*—Herb Boswell

[57] ABSTRACT

A toy suitable for attaching to infant furniture has an elongated track having ends with connecting members positioned on the ends of the track for connecting to an appropriate portion of the infant furniture, such as the side rails of a crib. A housing is mounted along the track. The housing includes a motor and associated components which drive the housing along the track. A stop member is located on each of the ends of the track. The housing includes a sensing lever which is engaged against the stop members on the respective ends of the track, so as to switch the direction of travel of the housing along the track. The housing also includes a musical device and a gear train driven by the motor for producing a constant output to drive the musical device.

17 Claims, 8 Drawing Figures

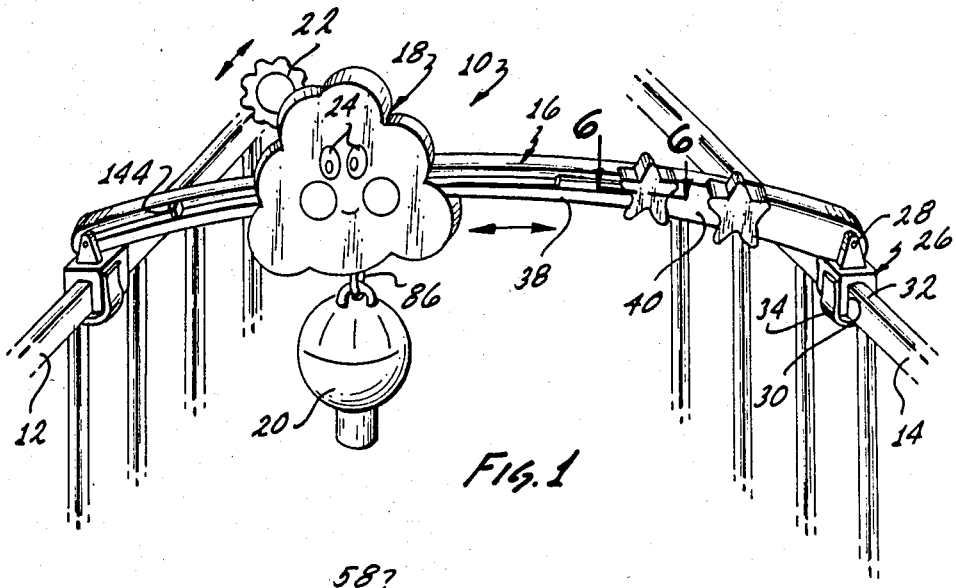
FIG. 1
FIG. 2
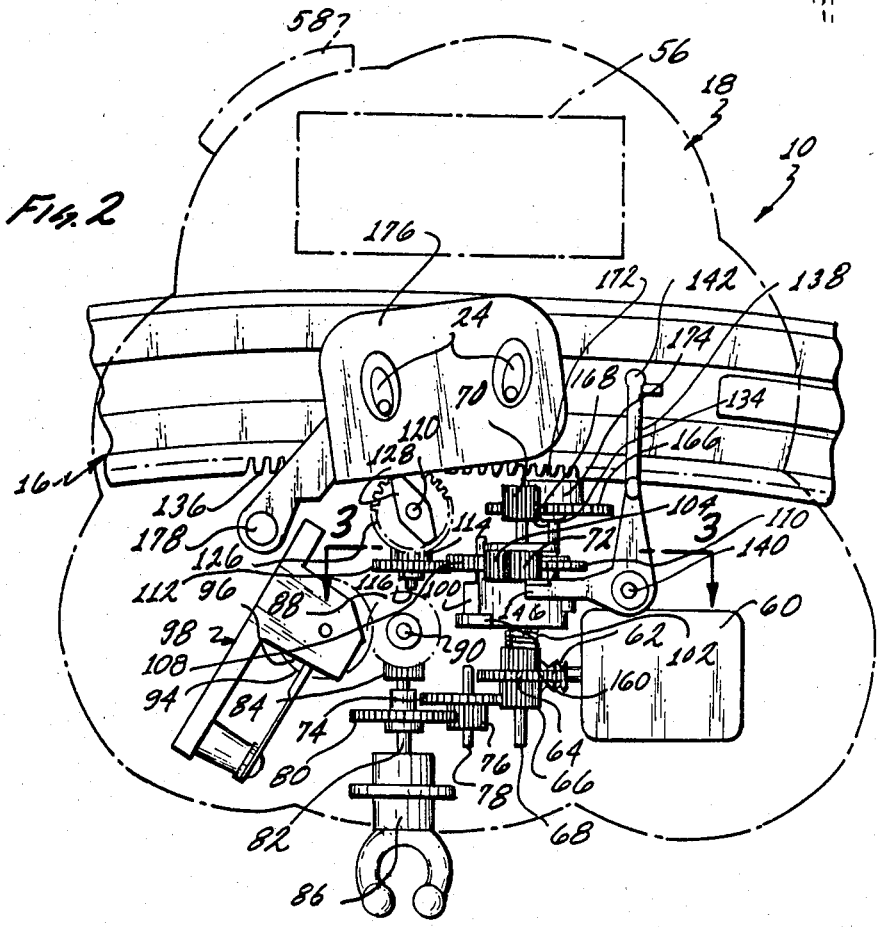

FIG. 6
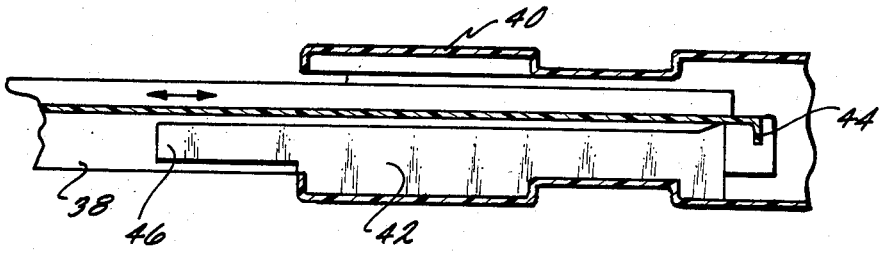
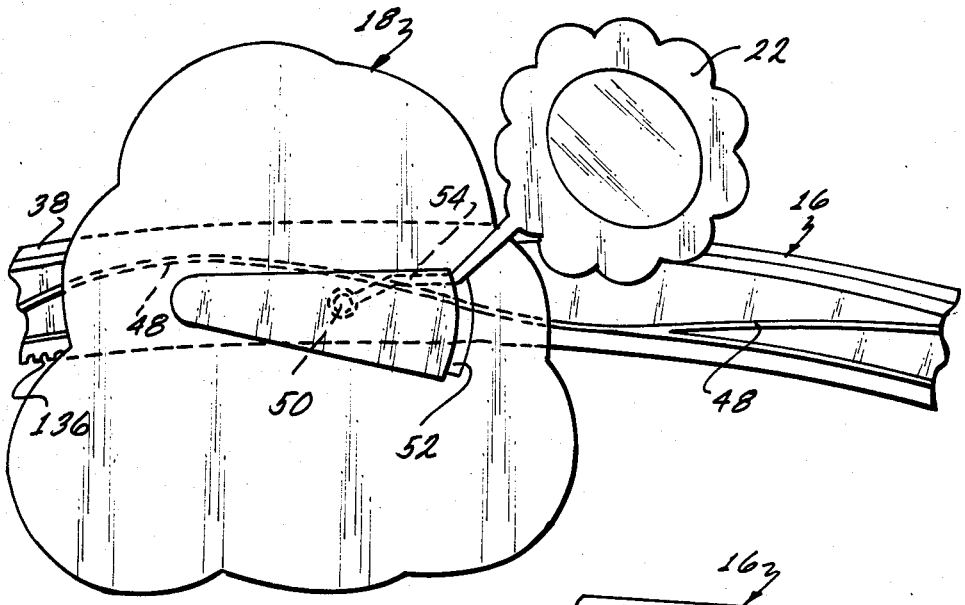
FIG. 7
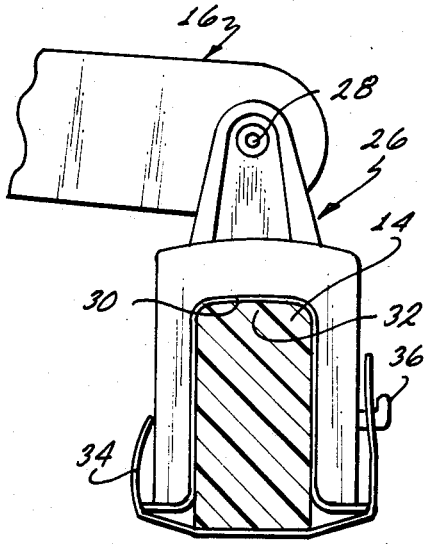
FIG. 8

TOY FOR USE WITH INFANT FURNITURE

BACKGROUND OF THE INVENTION

This invention is directed to a toy which can be attached to items of baby furniture and utilized to provide entertainment for an infant occupying the article of furniture. More specifically it includes an elongated track having a housing which is movable on the track. The track is attachable to railings or other structures on the items of furniture.

In order to assist infants in developing hand/eye coordination and other useful physiological and intellectual abilities, a variety of items have been developed which can be attached to a baby's crib, playpen, or the like. These include mobiles, and activity boxes or centers. A variety of visual and audio stimuli have been utilized with these devices.

For the most part the devices described in the preceeding paragraph have been constructed so they can attach to a single side rail of a crib, playpen, or the like. This construction is necessary because of the physical dimensions between opposing sides of items of baby furniture such as cribs, playpens, or the like. Further, with regard to cribs, normally the crib is manufactured such that the side rails can be raised or lowered. These generally move up and down vertically. However, some are constructed so as to use hinges allowing a top section to fold with respect to a bottom section. A movable side rail on a crib assists in placing the baby in and removing the baby from the crib, as well as allowing the surface of the crib to be utilized in changing the baby, or the like.

Heretofore, because of the movable side rails utilized almost universally in modern cribs, a toy or device for the crib has not been able to take advantage of the stability offered by attaching the device to both of the side rails of the crib. The reasons for this are two-fold based simply upon the geometry of the crib. First, not all cribs have their side rails placed at the exact same distance apart from one another. Thus, if a device was adapted for use on cribs of one size, it would be inoperable on a crib of a different size. Secondly, as the side rails of a crib are raised and lowered, the actual dimension betweem the tops of the individual side rails increase and decrease. Thus, even though a prior device may fit across the side rails when both of the side rails are in either the up or the down position, the device would not fit on the side rails when one side rail was moved and the other was held fixed.

The prior expedience which had been proposed to solve the above dilemma with regard to spacing of the side rails, have included suspending items across the side rails utilizing flexible cords, elastic cords, or springs. These have inherent problems. The use of a flexible cord can create a dangerous situation if for some reason the cord becomes untied and the baby seizes the end of the cord and becomes entangled in the same. Elastic cords have the same problem. Springs, on the other hand, provide convolutions in which the baby and/or its parent can be entangled in. This can cause pinching and bruising of body parts.

BRIEF DESCRIPTION OF THE INVENTION

In view of the above, it is evident that there exists a need for new and improved devices for utilization with items of baby furniture for the entertainment and physical development of the baby. It is a broad object of this invention to provide such a device. It is an additional object of this invention to provide a device which is easily attached to and detached from the item of baby furniture, yet when it is attached to the item of furniture will remain secure to the item of baby furniture. It is a further object of this invention in the illustrative embodiment of the invention, to provide a device which is capable of movement once attached to the item of furniture so as to provide for movement of one portion of the item of furniture with respect to the other without having to remove the device prior to this movement.

These and other objects, as will become evident in the remainder of this specification, are achieved in a toy which comprises an elongated track having ends; said track including a left side stop member on one of said ends; said track further including a right side stop member on the other of said ends; a housing mounted on said track between the respective ends of said track, said housing movable on said track between said ends of said track; motor means mounted on said housing, said motor means for propelling said housing on said track between said ends first in one direction towards said left side stop member and then in said opposite direction towards said right side stop member; stop member sensor means located on said housing, said stop member sensor means for sensing said right and said left side stop members, said stop member sensor means operatively associated with said motor means whereby when said stop sensor senses said right side stop member, said motor drives said housing in said one direction and when said stop sensor means senses said left side stop member, said motor drives said housing in said opposite direction.

Further these objects are achieved in a device for use in conjunction with a baby furniture item of the type having a first side railing and a second side railing opposite said first side railing, said device comprising an expandable and contractable track, said track having first and second ends; each of said ends of said track including a coupling means located thereon, said coupling means for attaching said track to said respective side railings of said furniture item; a motorized housing movable attaching to said track, said motorized housing capable of moving back and forth on said track between said ends of said track; a left side stop means mounted on one of said ends of said track and a right side stop member mounted on the other of said ends of said track; stop member sensor means located on said housing, said stop member sensor means for sensing said left and right side stop means and in response to sensing said left and right side stop means said motorized housing reversing directions of travel on said track.

In the illustrative embodiment of the invention, the track is an expandable track having first and second sections which are movable with respect to one another so as to be adaptable to items of furniture such as baby cribs wherein one portion of the item of furniture moves with respect to a second portion of the item of furniture.

In the illustrative embodiment, a musical device can be included in the housing so as to provide for audio stimulus for the infant, as well as including visually movable devices for providing visual stimulus for the infant. Because of this, when coupled with the back and forth movement of the housing across the track in the illustrative embodiment, a first output and a second output is provided with the first output providing the back and forth movement across the track and the second output providing a constant output to provide both the audio and visual devices of the invention. In the illustrative embodiment, the track portion is arcuate in shape such that it can form somewhat of a rainbow type bridge between the side railings of the crib. It is evident that the housing in moving upwardly along this arcuate shape, must move against gravity yet will be gravity assisted when moving down the arcuate shape. In the illustrative embodiment, a switching means is provided which allows for transferring of motion to produce the back and forth movement of the housing on the track, yet compensates for the gravity effects of the housing first having to move upwardly on the arcuate tract and then downwardly on the arcuate track.

BRIEF DESCRIPTION OF THE DRAWINGS

This invention will be better understood when taken in conjunction with the drawing wherein:

FIG. 1 is a perspective view showing use of the invention in association with two side rails of an infant crib;

FIG. 2 is an elevational view of the central portion of FIG. 1 with outside housing members removed for clarity of underlying parts;

FIG. 6 is a plan view in section about the line 6—6 of FIG. 1;

FIG. 7 is a rear elevational view of the central most portion of FIG. 1; and FIG. 8 is a fragmentary elevational view in partial section of the extreme right hand portion of FIG. 1.

Figure 3:
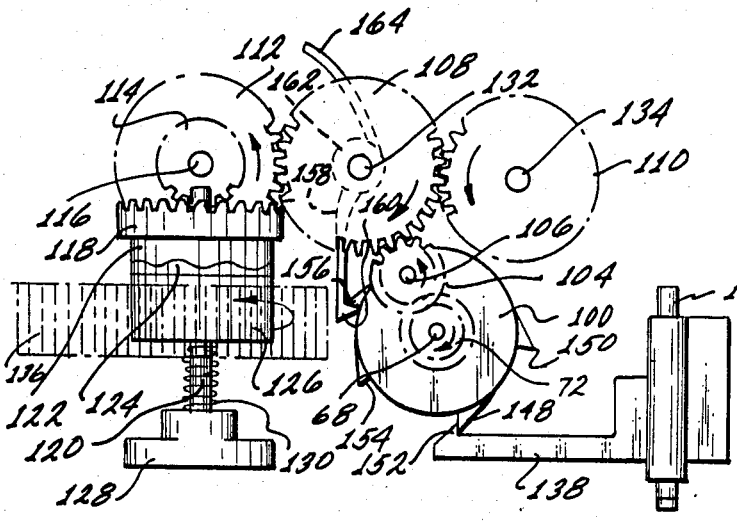
FIG. 3 is a fragmentary plan view about the line 3—3 of FIG. 2 showing certain parts in a first spacial configuration.

This invention utilizes certain principles and/or concepts as are set forth in the claims appended hereto. Those skilled in the toy arts will realize that these principles and/or concepts are capable of being expressed in a variety of embodiments which may differ from the embodiment utilized for illustrative purposes herein. For this reason this invention is not to be construed as being limited solely to the illustrative embodiment, but is only to be construed in view of the claims.

DETAILED DESCRIPTION OF THE INVENTION

FIG. 1 shows an embodiment of the invention as it is utilized in conjunction with the side rails of a typical crib. In FIG. 1 the crib toy 10 is connected between the left side rail 12 and the right side rail 14 of a crib (not separately numbered or shown). The crib toy 10 includes two major parts, a track 16 and a movable housing 18.

Basically, the crib toy 10 is operated as follows. Once attached to the particular item of baby furniture as hereinafter explained, the track 16 arches over the item of furniture such that it can be easily viewed by an infant lying underneath. By activating the small electric motor in the housing 18, the housing 18 travels back and forth, to the left, then to the right, and then back to the left, etc. etc. across the track 16. As it does this, a small music box within the interior of the housing 18 emits a musical tune. Further, a hot air balloon shaped object 20, which is suspended from the bottom of the housing 18, spins, and a sunburst shaped extension 22 projecting from the back of the housing 18 oscillates up and down. Simultaneously a pair of eyes, collectively identified by the numeral 24, moves back and forth across openings not separately numbered in the front face of the housing 18.

The track 16 is connected to the side rails 12 and 14 utilizing identical connectors, the right hand one which is shown in greater detail in FIG. 8. The connector 26 is pivoted via pin 28 to its respective end of the track 16. The utilization of the pin 28 allows the connector 26 to swivel with respect to the track 16 so as to make the crib toy 10 adaptable to many different types of infant furniture and allow for movement of one of the side rails 12 or 14 with respect to other of the side rails 12 or 14.

The connector 26 has an upside down U-shaped opening 30 allowing it to be slipped over the top of rung 32, or another suitable rung or top edge or the like, of the piece of infant furniture. Extending from the inside surface of the connector 26 is a flexible strap 34. On the outside of the connector 26, positioned away from the hands and eyes of an infant, is an elongated upwardly projecting dog 36 which fits into one of several elongated slots, not separately shown or numbered, formed in the strap 34. By forming the strap of a flexible but strong structural material, such as a suitable plastic, it can be tightly secured along the underneath of the rung 32 and attached to the dog 36. By incorporating a plurality of the before-mentioned slits in the strap 34, the connector 26 can be attached to a variety of thicknesses of different rungs 32.

The track 16 is a telescoping track formed of a first section 38 which telescopes into a second section 40. The location of the end of section 38 within the section 40 in a telescoping manner is shown in FIG. 6. Within the interior of the second section 40 is a web 42 which serves two purposes. The first purpose is to engage a small projection 44 formed on the end of first track section 38. This prevents track section 38 from being totally withdrawn from the interior of the second track section 40. The other end of the web, end 46, serves as a stop member identified in greater detail below.

As is evident from FIG. 1, the section 40 is approximately ¼ of the length of the section 38 which allows for elongation or shortening of the track 16 of approximately 20% while still maintaining a small portion of the first section 38 always located and locked within the second section 40 of the track 16. It is evident, as is obvious in FIG. 1, that if the side rail 12 is lowered with respect to the side rail 14, that the distance between their top rungs would increase. Since the track 16 is expandable, it can accommodate this increase in the distance between the top rungs 32 of the respective rails 12 and 14. Because of this, it is not necessary to remove the crib toy 10 from the rails 12 and 14 in order to lower and raise the same with respect to one another.

Looking now at FIG. 7, another feature of the track 16 is seen. A convoluted serpentine like web 48 is formed on the first track section 38. It is on the back side of the track, as the track is viewed in FIG. 1. The sunburst extension 22 is hinged via pin 50 to the interior of the housing 18. The extension 22 projects out of an elongated arcuate slot 52 located on the back of the housing 18. It further includes a small following pin 54 formed thereon. The following pin 54 rides on top of the convoluted wed 48 and, as the housing 18 goes back and forth along the track 16, the following pin 54 follows the web 48 riding up and down along its crests, sides, and troughs. This causes the sunburst extension 22 to oscillate within the slot 52 and to move upwardly and downwardly in an arcuate manner along the left hand side of the housing 18 as seen in FIG. 1.

Referring now to FIG. 2, an over all view of the interior of the crib toy 10 is shown. A battery (not separately numbered and shown) is located within the battery storage department 56 formed in the top portion of the housing 18. An off/on switch 58 completes or breaks a circuit between the battery located within the battery compartment 56 and a small electrical motor 60 located in the bottom portion of the housing 18. Attached to the output shaft of the motor 60 is a worm gear 62. The worm gear 62 meshes with a spur gear 64 which is formed in conjunction with a pinion gear 66. Both of these are fixed to a shaft 68 such that they and the shaft 68 rotate in unison in response to rotation of the worm gear 62. Two other pinion gears are fixed to shaft 68 and rotate in conjunction with it. These are pinions 70 located on one end of the shaft 68 and pinion 72 located near the middle of shaft 68.

A spur gear 74 meshes with the pinion 66. Spur gear 74 is intrically formed with a pinion 76, and both of them rotate on a shaft 78. A further spur gear 80 meshes with pinion 76. Spur gear 80 is fixed to a shaft 82 which also carries a pinion 84 fixedly attached to it. On the end of shaft 82 opposite the pinion 84 is a connector 86 which rotates in response to rotation of the shaft 82. The balloon 20 snaps inbetween the tines of the connector 86 so as to connect the balloon 20 to the housing 18. Since the shaft 82 is ultimately rotated via output of the motor 60, the balloon 20 rotates with respect to the housing 18.

A crown gear 88 formed on a shaft 90 meshes with the pinion 84. The crown gear 88 is fixed to the shaft 90, and further fixed to the shaft 90 is a spur gear 92.

The spur gear 92 meshes with a spur gear 94 which is fixed to a drum 96 of a music box 98. Thus, the drum 96 of the music box 98 also is rotated via the output of the motor 60. The music box 98 is conventional in construction and includes a plurality of tines which are collectively identified by the numeral 99 which are engaged by projections not separately identified or numbered located on the surface of the drum 96.

The direction of rotation of the worm gear 62, serving as the output gear of the motor 60, is always in a constant direction. This rotation is fed via the above described gear train to the connector 86 and the music box drum 96. Since the gear train between these elements and the motor 60 is always constant, they have a constant output (a constant direction of rotation).

A further gear train leads from the shaft 68 to the mechanism which moves the housing 18 back and forth across the track 16. This includes a switch as hereinafter described in greater detail, which shifts between two output gear trains, one having an extra gear compared to the other, resulting in a first instance an output rotation which is in the same direction as the direction of rotation of the motor 60 and in the second instance an output rotation which is reversed from the direction of the rotation of the motor 60. This drives the housing 18 back and forth across the track 16.

A selector drum 100 is mounted on the shaft 68, however, it is free to rotate independent of the rotation of shaft 68. A small compression spring 102 axially biases the drum 100 against the surface of the pinion 72. It will be remembered that the pinions 72 rotate in conjunction with rotation of the shaft 68. If nothing inhibits the drum 100, the bias induced by the spring 102, pressing the drum 100 against the pinion 72, will cause the drum 100 to rotate in conjunction with the pinion 72, i.e. with the shaft 68. If, however, anything inhibits rotation of the selector drum 100, it will simply slip on the surface of the pinion 72 and will not rotate in conjunction with it or the shaft 68.

Selector drum 100 carries a planetary pinion 104 on it. The planetary pinion 104 is free to rotate about a small boss 106 formed on the selector drum 100. The boss 106 extends parallel with the shaft 68 such that the axis of rotation of the planetary pinion 104 is also parallel to the axis of rotation of selector drum 100, i.e. is parallel with the shaft 68. The planetary pinion 104 meshes with the pinion 72 and, thus, is rotated in response to rotation of the pinion 72 which in turn is rotated via the shaft 68. At all times, therefore, when the shaft 68 is rotating, the pinion 72 and the planetary pinion 104 are rotating.

Figure 4:
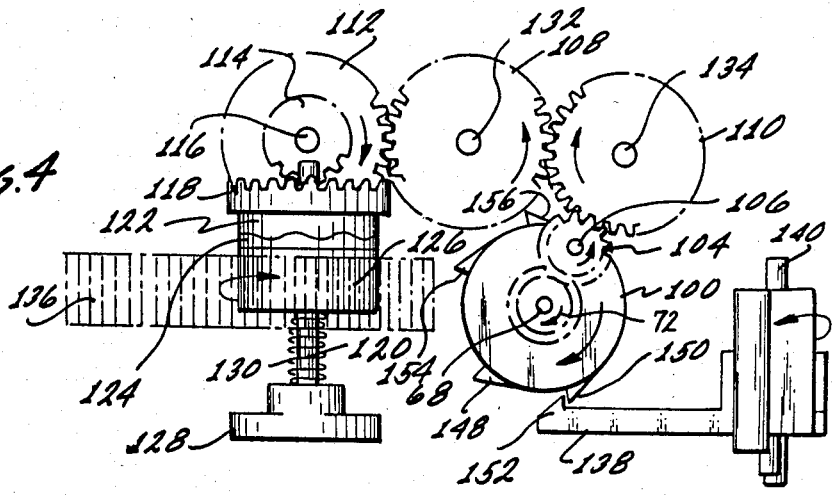
FIG. 4 is a view similar to FIG. 3 except it shows certain of the components in a further spacial configuration.
Figure 5:
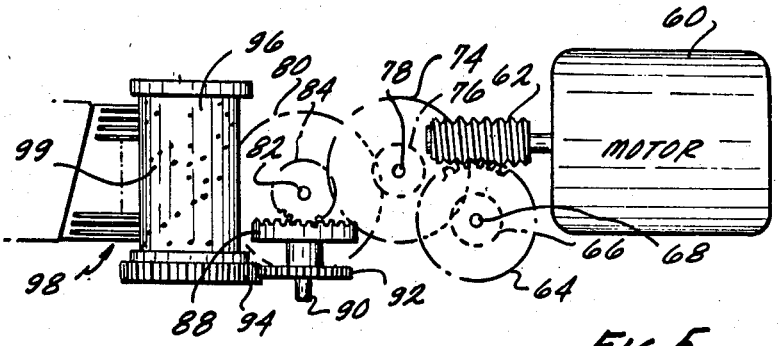
FIG. 5 is a bottom plan view of certain of the components of FIG. 3.

Additionally, the planetary pinion 104 can orbit about the shaft 68 in response to rotation of the selector drum 100. During a complete orbit about the shaft 68, the orbit of the planetary pinion 104 first engages with a spur gear 108 as seen in FIG. 3, and subsequently engages with a spur gear 110 as seen in FIG. 4. Prior to discussing what holds it in engagement with these two gears, however, the output gear train which drives the housing 18 across the track 16, will be described.

A spur gear 110 is in mesh with spur gear 108. Spur gear 108 in turn is in mesh with a further spur gear 112. A small pinion 114 is intrically formed with spur gear 112, and both of these are fixedly attached and rotate in conjunction with a shaft 116. The pinion 114 meshes with a crown gear 118 fixed to a shaft 120. Intrically formed with the crown gear 118 is a reentrant gear 122. It meshes with a further reentrant gear 124 intrically formed with a large pinion 126. A cam 128 if fixed to the end of the shaft 120, and a compression spring 130 is located between the cam 128 and the large pinion 126. The spring 130 compresses the large pinion 126 and its reentrant gear 124 formed thereon against the reentrant gear 122 such that rotation of the crown gear 118 is transferred to the large pinion 126 if nothing inhibits rotation of the pinion 126. If something does inhibit rotation of the pinion 126, the reentrant gear 124 slips with respect to the reentrant gear 122.

In FIG. 3, the planetary gear 104 is seen in engagement with the spur gear 108 carried on shaft 132. Rotation then is transferred from spur gear 112 ultimately to the large pinion 126. In FIG. 4, the planetary gear 104 is engaged with the spur gear 110 which is carried on shaft 134. The spur gear 110 then meshes with spur gear 108 with rotation then further propogated to the large pinion 126. In moving between FIGS. 3 and 4, it can be seen that an extra gear, i.e. spur gear 110, is introduced into the ultimate gear train between the planetary ger 104 and the large pinion 126. The gear train of FIG. 3 has one less gear than the gear train of FIG. 4, therefore, the pinion 126 will rotate in a first direction when the gear train of FIG. 3 is utilized, and in the opposite direction when the gear train of FIG. 4 is utilized. By switching the planetary gear between gears 108 and 110, ultimately the direction of rotation of the large pinion 126 can be reversed.

An elongated rack of gears 136 is formed along the bottom edge of first section 38 of the track 16. The large pinion 126 meshes with this rack of gears 136. As the pinion 126 rotates, it moves along the rack of gears 136.

Since the pinion 126 is carried on the shaft 120 which is journalled within the housing 18, movement or rotation of the pinion 126 along the gear rack 126 moves the housing 18, and all parts connected thereto, along the track 16. If the on/off switch is in the off position such that the motor 60 is not rotating, and the housing 18 is moved by hand across the track 16, this will cause rotation of the large pinion 126. However, since the crown gear 118 is not rotating, the reentrant gear 124 will slip with respect to the reentrant gear 122 to prevent damage to any of the gear train components.

The planetary pinion 104 positioned as per FIGS. 3 and 4 is held in those positions as follows. A stop member sensor lever 138 shaped as a bell crank is mounted within the housing 18 via small axle shafts collectively identified by the numeral 140 located at its "elbow". An end of arm 142 of this lever 138 is positioned such that when the housing 18 moves arcuately along the track 16 toward the right as seen in FIG. 1, it contacts the stop member 46. This causes rotation of the lever 138 about the axle shaft 140 in a counterclockwise direction as seen in FIG. 2. Located near the left hand side of the track 16 is a further stop member 144. When the housing 18 travels to the left as seen in FIG. 1, ultimately the arm 142 of the lever 138 contacts the stop member 144 rotating it clockwise to the position seen in FIG. 2. Thus, each time the housing 18 nears either the right or the left hand side of the track 16, the arm 142 of the stop member sensing lever 138 engages one or the other of the stop members 46 or 144, and is moved by the contact against the stop members 46 and 144.

The other arm 146 of the stop member sensor lever 138 is positioned over the top of the cylindrical surface of the selector drum 100. On the cylindrical surface of the selector drum 100 are two sets of ratchet teeth. The first set is positioned near the top and in the middle of the selector drum as seen in FIG. 2. These include ratchet teeth 148 and 150. The ratchet teeth 148 and 150 are circumferentially displaced with respect to one another around the circumferential surface of the selector drum 100. Additionally, they are axially displaced with respect to one another along the axis of the selector drum 100. In FIG. 2 the arm 146 of the lever 138 is directly over the ratchet tooth 148. It can be seen that the ratchet tooth 150, as well as being circumferentially displaced from the ratchet tooth 148, is axially displaced downwardly from it. In FIGS. 3 and 4, the circumferential displacement of these two ratchet teeth is evident.

When the stop member sensor lever 138 is rotated counterclockwise, a small dog 152 on the end of arm 146 is positioned so as to be able to engage ratchet tooth 148 located on the selector drum 100, if the selector drum 100 rotates. When the stop member selector lever 138 is rotated counterclockwise, the arm 146 is also rotated counterclockwise which positions the dog 152 in a position so as to be able to engage the ratchet tooth 150. As noted above, if nothing inhibits the selector drum 100, it will rotate in conjunction with rotation of the pinion 72. The position of the selector drum 100 and the stop member sensor lever 138 is the same in moving between FIGS. 2 and 3. It can be seen that in this position the dog 152 on the end of arm 142 has engaged the ratchet tooth 148 inhibiting clockwise rotation of the selector drum 100. Now, if the stop member sensor lever 138 is rotated counterclockwise, the dog 152 moves axially across the circumferential surface of the selector drum 100 positioning it downwardly in FIG. 2 from the ratchet tooth 148 but in line with the ratchet tooth 150. Since it no longer is engaged with the ratchet tooth 148, the friction between the pinion 72 and the selector drum 100 can now rotate the selector drum 100 until the ratchet tooth 150 engages the dog 152. This ceases further rotation of the selector drum 100.

If the stop member sensor lever 138 is now rotated from the position seen in FIG. 4 to position seen in FIG. 3, the dog 152 will release from the ratchet tooth 150 allowing the selector drum 100 to do almost a full rotation until the ratchet tooth 148 again catches against the dog 152. The movement of the stop member sensor lever 138, as it is contacted by the arm 146 and the stop members 46 and 144, shift the dog 152 axially across the surface of the selector drum 100 to engage first one and then the other of ratchet teeth 148 and 150 so as to reverse the output of the pinion 126.

The track 16 is arcuate in shape. The housing 18, in moving from the left hand side of track 16 toward the right hand side, must first ascend up a grade until it reaches the apex of the track 16, and then it descends down toward the right hand side. It is obvious that the housing 18 is working against gravity in ascending up the grade, and is gravity assisted in descending down the grade.

In order to prevent backlash to the drum 100 during the gravity assist portion of the travel of the housing 18, a second set of ratchet teeth 154 and 156 are also located on the selector drum 100. They are oriented along the cylindrical surface of the selector drum 100 in the opposite orientation as are the ratchet teeth 148 and 150. As seen in FIGS. 3 and 4, the ratchet teeth 148 and 150 could be considered as being pointed in a clockwise direction, whereas the ratchet teeth 154 and 156 could be considered as being pointed in a counterclockwise direction. In any event, a small arm 158 carrying adog 160 on the end thereof, is positioned so as to engage the ratchet teeth 154 and 156. The arm 158 is attached to a bushing 162 which is located about shaft 132 but is free to rotate independent of shaft 132. A small spring arm 164 projects downwardly from the bushing 162 and contacts the inside surface of the housing 18. This biases the dog 160 toward the surface of the selector drum 100 but allows for rotation of the bushing 162 and the arm 158 attached thereto about the shaft 132 by flexing of the spring arm 164.

The arm 158 and the dog 160 attached thereto are located with respect to the arm 142 and the dog 152 attached thereto such that when the dog 152 engages the ratchet tooth 148, the dog 160 is engaged with the ratchet tooth 156. Further, when the dog 152 is engaged against the ratchet tooth 150, the dog 160 is engaged with the ratchet tooth 154. The bias in the spring arm 164 is very weak, such that as the selector drum 100 is frictionally rotated by the pinion 72, the wedge shaped surface on the backside of the ratchet teeth 154 and 156 is enough pushing against the end of the arm 158 to flex the spring 164 allowing for movement of ratchet teeth 154 and 156 underneath the dog 160 clockwise as seen in FIGS. 3 and 4 but inhibiting counterclockwise movement.

As the housing 18 is gravity assisted down the downward sloping of the side of the track 16, backlash within the gear train between the pinion 126 to the planetary pinion 104 can occur. This would tend to rotate the planetary pinion 104 out of its engagement with either the spur gear 108 or 110. However, because of the presence of the ratchet teeth 154 and 156 preventing counterclockwise movement of the selector drum 100 as seen in FIGS. 3 and 4, the backlash movement of the planetary pinion 104 tending to move it out of engagement with the spur gears 108 and 110 is prevented.

In addition to preventing backlash movement of the planetary pinion 104, the housing 18 is further equipped with a friction feed to prevent the gravity assisted movement of the housing 18 to be faster than the uphill ascent. The pinion 70, previously identified, meshes with a spur gear 166. The spur gear 166 is freely mounted to the shaft 134 and, thus, rotates independent of this shaft. The shaft 134, however, includes the spur gear 110 which is fixed to it, and, thus, rotates in conjunction with it. As noted the spur gear 110 meshes with the pinion 104 and is rotated by it. On the opposite end of the shaft 134 is a bushing 172 (a portion of which is seen just behind the gear teeth 136 in FIG. 2) which is fixed to the shaft 134 and rotates in conjunction with it. Interspaced between the bushing 172 and the spur gear 166 is a flexible collar 174 which forms a frictional engagement between the spur gear 166 and the bushing 172.

Since both the pinion 72 and the pinion 70 are fixed to the shaft 68, they both rotate in conjunction with one another. The pinion 72 through pinon 104 directly meshes with the spur gear 110 and through the pinion 104 and the spur gear 108 indirectly meshes with the spur gear 110. The pinion 70 meshes with the spur gear 166. The spur gear 166 is of a slightly different size than is the spur gear 110, and as such, they rotate at different speeds. Since the bushing 172 is connected to the same shaft as is the spur gear 110, they rotate at the same speed of rotation. Since the speed of rotation, however, of the spur gear 166 is different than the speed of rotation of the bushing 172, they slip with respect to one another along the flexible collar 174. This serves as a speed governor to keep the speed of ascent of the housing 18 the same as the speed of descent of the housing 18 along the track 16.

The cam 128, aside from serving as a positioning element for the spring 130, also engages the underside of a member 176 on which the eyes 24 are carried. The member 176 is pivoted via a boss 178 to the inside of the housing 18. As the lobs of the cam 128 rotate, they engage the bottom of the member 176 raising and lowering it such that the eyes 24 move with respect to the openings in the housing 18.

I claim:

1. A toy which comprises:

an elongated intregal non-bending track having ends;

said track including a left side stop member on one of said ends;

said track further including a right side stop member on the other of said ends;

a housing mounted on said track between the respective ends of said track, said housing movable on said track between said ends of said track;

said track includes left and right side coupling means, said left side coupling means located on the left side of said track and said right side coupling means located on the right side of said track;

said left and right side coupling means for attaching said track to a further structure and to suspend said track and said housing as an integral unit over said structure;

motor means mounted on said housing, said motor means for propelling said housing on said track between said ends first in one direction towards said left side stop member and then in the opposite direction towards said right side stop member;

stop member sensor means located on said housing, said stop member sensor means for sensing said right and said left side stop members, said stop member sensor means operatively associated with said motor means whereby when said stop sensor senses said right side stop member, said motor drives said housing in said one direction and when said stop sensor means senses said left side stop member, said motor drives said housing in said opposite direction;

said track being an expandable track having at least first and second sections which are operatively associated with one another and are capable of telescoping into one another along the elongated axis of said track with respect to one another to foreshorten and elongate said track.

2. The toy of claim 1 wherein: said motor means includes a motor and at least a first drive train means, said first drive train means operatively associated with said motor so as to be driven by said motor and in response to being driven by said motor said first drive train means capable of producing an output in a first direction and an output in a second direction, said output in said first direction driving said housing in said one direction and said output in said second direction driving said housing in said opposite direction.

3. The toy of claim 1 wherein: said housing includes music means located thereon, said music means capable of producing a musical output, said music means operatively associated with said motor means so as to be driven by said motor means.

4. The toy of claim 2 including: a second drive train means, said second drive train means operatively associated with said motor so as to be driven by said motor and in response to being driven by said motor said second drive train means producing a constant output in a constant direction.

5. The toy of claim 4 wherein: said housing includes music means located thereon, said music means capable of producing a musical output, said music means operatively associated with said second drive train means so as to be driven by said second drive train means to produce said musical output.

6. The toy of claim 2 wherein:

said first drive train means includes a first output means and a second output means and a switch means;

said switch means operatively associated with said motor and each of said first and said second output means, said switch means for connecting said motor to one or the other of said first and said second output means whereby said motor at any one instance drives one or the other of said first and said second output means;

said first output means producing said output in said first direction to drive said housing in said one direction and said second output means producing said output in said second direction to drive said housing in said opposite direction.

7. The toy of claim 1 wherein:

said track includes a track gear means located thereon;

said housing includes a housing gear means located thereon, said housing gear means in constant engagement with said track gear means, said motor means driving said housing gear means to move said housing gear means on said track gear means so as to propel said housing on said track.

8. The toy of claim 2 wherein:

said track includes a track gear means located thereon;

said first drive train means includes a housing gear means, said housing gear means in constant engagement with said track gear means, said motor means driving said housing gear means to move said housing gear means on said track gear means so as to propel said housing on said track.

9. The toy of claim 8 wherein:

said housing gear means includes a housing gear;

said first drive train means includes a first gear train and a second gear train and a switch means;

said switch means operatively associated with said motor and each of said first and said second gear trains, said switch means for connecting said motor to one or the other of said first and said second gear trains whereby said motor at any one instance drives one or the other of said first and said second gear trains;

each of said first and said second gear trains being operatively connected to said housing gear so as to rotate said housing gear;

said first gear train rotating said housing gear in a first direction to move said housing in said one direction and said second gear train rotating said housing gear in a second direction to move said housing in said opposite direction.

10. The toy of claim 9 including:

a second drive train means, said second drive train means operative associated with said motor so as to be driven by said motor and in response to being driven by said motor said second drive train means producing a constant output in a constant direction;

said housing including music means capable of producing a musical output, said music means operatively associated with said second drive train means so as to be driven by said second drive train means to produce said musical output.

11. A toy which comprises:

an elongated track having ends;

said track including a left side stop member on one of said ends;

said track further including a right side stop member on the other of said ends;

a housing mounted on said track between the respective ends of said track, said housing movable on said track between said ends of said track;

said track includes left and right side coupling means, said left side coupling means located on the left side of said track and said right side coupling means located on the right side of said track;

said left and right side coupling means for attaching said track to a further structure and to suspend said track and said housing as an integral unit over said structure;

motor means mounted on said housing, said motor means for propelling said housing on said track between said ends first in one direction towards said left side stop member and then in the opposite direction towards said right side stop member;

stop member sensor means located on said housing, said stop member sensor means for sensing said right and said left side stop members, said stop member sensor means operatively associated with said motor means whereby when said stop sensor senses said right side stop member, said motor drives said housing in said one direction and when said stop sensor means senses said left side stop member, said motor drives said housing in said opposite direction;

said motor means includes a motor and at least a first drive train means, said first drive train means operatively associated with said motor so as to be driven by said motor and in response to being driven by said motor said first drive train means capable of producing an output in a first direction and an output in a second direction, said output in said first direction driving said housing in said one direction and said output in said second direction driving said housing in said opposite direction;

said first drive train means includes a first output means and a second output means and a switch means;

said switch means operatively associated with said motor and each of said first and said second output means, said switch means for connecting said motor to one or the other of said first and said second output means whereby said motor at any one instance drives one or the other of said first and said second output means;

said first output means producing said output in said first direction to drive said housing in said one direction and said second output means producing said output in said second direction to drive said housing in said opposite direction;

said switch means includes a shaft and a cylindrical element freely rotatably mounted on said shaft with said shaft passing through the axis of rotation of said cylindrical element;

a pinion gear mounted on said shaft adjacent to said cylindrical element;

said cylindrical element having a planetary gear rotatably mounted thereon and located such that the axis of rotation of said planetary gear is parallel to the axis of rotation of said pinion gear on said shaft, said planetary gear located on said cylindrical element so as to be in engagement with said pinion gear and to orbit around said pinion gear, said pinion gear rotating said planetary gear about the axis of rotation of said planetary gear;

a plurality of output gears located next to the orbit of said planetary gear whereby said planetary gear at any one said instance can engage with one of said plurality of output gears;

a first plurality of ratchet teeth equal in number to the number of said plurality of said output gears, said first plurality of ratchet teeth located on the cylindrical surface of said cylindrical element, said first plurality of ratchet teeth both circumferentially and axially displaced from one another on said cylindrical surface of said cylindrical element, each of said first plurality of ratchet teeth circumferentially oriented in the same direction;

a second plurality of ratchet teeth equal in number to said first plurality of ratchet teeth, said second plurality of ratchet teeth located on said cylindrical surface of said cylindrical element, said second plurality of ratchet teeth circumferentially displaced from one another on said cylindrical surface of said cylindrical element, each of said second plurality of ratchet teeth circumferentially oriented in the direction opposite from the orientation of said first plurality of ratchet teeth;

a first ratchet tooth engagement member located in association with said cylindrical element and axially movable across the cylindrical surface of said cylindrical element, said first ratchet tooth engagement member positioned with respect to said cylindrical element so as to engage one at a time each of said first plurality of ratchet teeth;

a second ratchet tooth engagement member located in association with said cylindrical element, said second ratchet tooth engagement member located in a position with respect to said cylindrical surface of said cylindrical element so as to engage one at a time each of said second plurality of ratchet teeth.

12. A device for use in conjunction with a baby furniture item of the type having a first side railing and a second side railing opposite said first side railing, said device comprising:

a track, said track having at least first and second sections, said first section telescoping into said second section to elongate and foreshorten said track;

said track having first and second ends, said first end located on said first section of said track and said second end located on said second section of said track;

each of said ends of said track including a coupling means located thereon, said coupling means for attaching said track to said respective side railings of said furniture item;

a motorized housing movably attaching to said track, said motorized housing capable of moving back and forth on said track between said ends of said track;

a left side stop means mounted on one of said ends of said track and a right side stop member mounted on the other of said ends of said track;

stop member sensor means located on said housing, said stop member sensor means for sensing said left and right side stop means and in response to sensing said left and right side stop means said motorized housing reversing directions of travel on said track;

said track includes an elongated gear rack located thereon;

said motorized housing including a motor and housing gear, said housing gear rotatably mounted on said housing and rotated by said motor in first and second directions in response to said stop member sensor sensing said left and right side stop means;

said housing gear in engagement with said elongated gear rack so as to move along said gear rack in response to rotation of said housing gear.

13. The device of claim 12 wherein: said motorized housing includes music means capable of producing a musical output, said music means producing said musical output as said motorized housing moves along said track.

14. The device of claim 12 wherein: said motorized housing further including first and second gear trains located between said motor and said housing gear, said first gear train rotating said housing gear in said first direction and said second gear train rotating said housing gear in said second direction.

15. The device of claim 14 wherein: said motorized housing further including a switch means located between said motor and each of said first and second gear trains, said switch means connecting one at a time one of said first and second gear trains to said motor whereby said motor will rotate the respective gear trains connected to it and in turn said respective gear train rotating said housing gear.

16. The device of claim 15 wherein:

said motorized housing further including a stop member sensor;

said stop member sensor operatively connected to said switch means, said switch means switching the connection between said motor and said first and second gear trains in response to said stop member sensor contacting one of said left or right side stop means.

17. A switching device for a gear train which comprises:

said switching device having a shaft and a cylindrical element freely rotatably mounted on said shaft with said shaft passing through the axis of rotation of said cylindrical element;

a pinion gear mounted on said shaft adjacent to said cylindrical element;

said cylindrical element having a planetary gear rotatably mounted thereon and located such that the axis of rotation of said planetary gear is parallel to the axis of rotation of said pinion gear on said shaft, said planetary gear located on said cylindrical element so as to be in engagement with said pinion gear and to orbit around said pinion gear, said pinion gear rotating said planetary gear about the axis of rotation of said planetary gear;

a plurality of output gears located next to the orbit of said planetary gear whereby said planetary gear at any one instance can engage with one of said plurality of output gears;

a first plurality of ratchet teeth equal in number to the number of said plurality of said output gears, said first plurality of ratchet teeth located on the cylindrical surface of said cylindrical element, said first plurality of ratchet teeth circumferentially and axially displaced from one another on said cylindrical surface of said cylindrical element, each of said first plurality of ratchet teeth circumferentially oriented in the same direction;

a second plurality of ratchet teeth equal in number to said first plurality of ratchet teeth, said second plurality of ratchet teeth located on said cylindrical surface of said cylindrical element, said second plurality of ratchet teeth circumferentially displaced from one another on said cylindrical surface of said cylindrical element, each of said second plurality of ratchet teeth circumferentially oriented in the direction opposite from the orientation of said first plurality of ratchet teeth;

a first ratchet tooth engagement member located in association with said cylindrical element and axially movable across the cylindrical surface of said cylindrical element, said first ratchet tooth engagement member positioned with respect to said cylindrical element so as to engage one at a time each of said first plurality of ratchet teeth;

a second ratchet tooth engagement member located in association with said cylindrical element, said second ratchet tooth engagement member located in a position with respect to said cylindrical surface of said cylindrical element so as to engage one at a time each of said second plurality of ratchet teeth;

the number of said second plurality of ratchet teeth equal in number to the number of said first plurality of ratchet teeth, each of said first ratchet teeth operatively associated with one of said second ratchet teeth whereby when said first ratchet tooth engagement member engages one of said first ratchet teeth said second ratchet tooth engagement member engages the second ratchet tooth operatively associated with the respective first ratchet tooth.

* * * * *

UNITED STATES PATENT AND TRADEMARK OFFICE

CERTIFICATE OF CORRECTION

PATENT NO. : 4,664,640

DATED : MAY 12, 1987

INVENTOR(S) : YASUSHI SHINDO AND TOSHIAKI KURITA

It is certified that error appears in the above-identified patent and that said Letters Patent is hereby corrected as shown below:

Column 1, lineS 19 and 20, "preceeding" should be --preceding--,
Column 1, lines 44 and 45, "between" should be --between--,
Column 3, line 26, "spacial" should be --spatial--,
Column 3, line 29, "spacial" should be --spatial--,
Column 4, line 66, "wed" should be --web--,
Column 5, line 8, "department" should be --compartment--,
Column 5, line 29, "inbetween" should be --in between--,
Column 6, line 53, "propogated" should be --propagated--,
Column 6, line 56, "ger" should be --gear--, and
Column 7, line 3, "rack 126" should be --rack 136--.

Signed and Sealed this

Twenty-ninth Day of March, 1988

*Attest:*

DONALD J. QUIGG

*Attesting Officer*

*Commissioner of Patents and Trademarks*